United States Patent [19]

McKenney

[11] 4,378,614

[45] Apr. 5, 1983

[54] AUTOMATIC-RELEASE HOOK FOR SAILBOARD HARNESS

[76] Inventor: John McKenney, 20 Vista del Sol, South Laguna, Calif. 92677

[21] Appl. No.: 184,798

[22] Filed: Sep. 8, 1980

[51] Int. Cl.[3] ..... A44B 13/00; A44B 19/00

[52] U.S. Cl. ..... 24/201 TR; 24/230.5 R

[58] Field of Search ..... 24/192, 201 TR, 230.5 R, 24/238, 242, 263 B, 263 SB, 328, 374, 377; 54/49; 114/205, 215, 217, 247, 252

[56] References Cited

U.S. PATENT DOCUMENTS 2,568,939 9/1951 Wilson ..... 24/242

FOREIGN PATENT DOCUMENTS 160212 12/1954 Australia ..... 54/49

1226574 7/1960 France ..... 54/49

*Primary Examiner*—Robert P. Swiatek

*Attorney, Agent, or Firm*—Lawrence Fleming

[57] ABSTRACT

A releasable hook assembly for use on a trapeze-type harness worn in the sport of sailboarding. A cord or line from the boom passes through the hook to reduce strain on the sailor's arms. The hook extends outward from a base plate which is supported over the sailor's chest by the harness, and is pivoted to swing outward to release the boom line. A latching engagement of the base portion of the hook to a hole in the base plate prevents such swinging or rotation until the line tension becomes great enough to overcome the force of a leaf spring to disengage the latch. The tension required is adjustable.

7 Claims, 5 Drawing Figures

AUTOMATIC-RELEASE HOOK FOR SAILBOARD HARNESS

BACKGROUND

This invention relates to the sport of sailboarding. A sailboard comprises a hull or board made generally like a surfboard, fitted with a mast and sail. The base of the mast is connected to the board via a universal joint. The sailor stands on the board facing generally athwart, grasping the boom with both hands, and leans back to balance the force of the wind on the sail. The craft is steered by tilting the mast.

To reduce fatigue in the arms when sailing in strong winds, a sailor may wear a trapeze harness having a hook in front, over the chest. A cord or line is run from the boom through the hook to take the pulling force of the boom.

When this force increases out of control, as from a mistake in sailing or a sudden wind gust, it is necessary to release the boom quickly. Some harnesses are equipped with simple fixed hooks from which the sailor releases the cord or line by hand. Other known kinds of harness hooks have trigger or latch-type release mechanisms operated by the sailor, as by pulling a lanyard or by striking a trip element with the chin. I am not aware of any prior such hooks which release automatically at a predetermined force.

The use of harnesses in sailboarding is described on pages 230–232 of the book, "A Complete Guide to Windsurfing" by Glenn Taylor, published in 1979 by Bay Windsurfing, Box 770, Menlo Park, California, U.S.A. Sailboards are sold under trade names such as "Windsurfer" and "Windglider".

BRIEF DESCRIPTION

The present invention is an improved, simple and adjustable, automatic-release harness hook or hook assembly. It comprises a base plate supporting a leaf spring having a folded central ridge portion that fits over a pivot pin. The pin passes through the base portion of a latch hook; when the hook is free to rotate about this pin it releases the line. To prevent such rotation in normal circumstances, the base end of the latch hook has a notch which includes a flat engaging surface that engages a parallel engaging surface on the base plate such as the side of a hole in the said plate, in the general manner of the trigger-sear engagement in a gun. An outward pull on the hook, as from a boom line, tends to pull the hook in translation outward from the base plate, against the inward urging of the leaf spring, the said two engaging surfaces sliding along each other. The hook cannot rotate, however, so long as these surfaces remain engaged. When the outward pull increases enough to pull the notch clear of the base plate, the hook is then free to rotate outwardly on its pivot pin. The pull of the line will so rotate the hook, releasing the line.

The pulling force required to release the hook depends on the spring constant and the preload of the leaf spring that retains the hook's pivot pin. The preload is adjustable by, e.g., an adjusting nut disposed to hold down one end of the leaf spring against the base plate.

DETAILED DESCRIPTION

Figure 1:
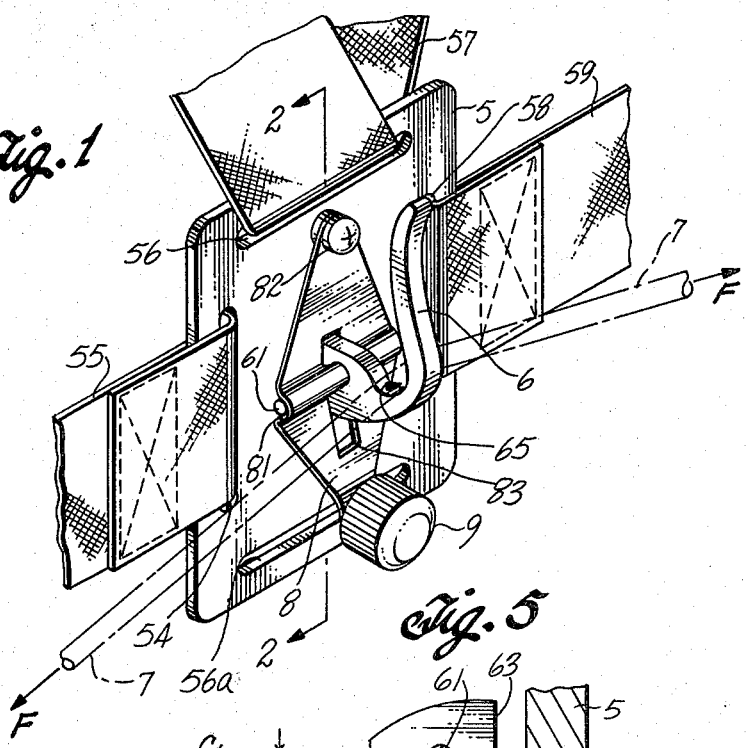
FIG. 1 is a perspective view of a hook of the invention.

Referring first to FIG. 1, portions of a webbing harness 55, 57, 59 are indicated attached to a base plate 5 which has a hook 6 and slots 54, 56, 58. Strap 57 has two portions which normally extend back over the wearer's shoulders; and straps 55 and 59 extend across the chest, all being connected together at the sailor's back. The hook assembly is disposed about in the center of the sailor's chest.

Base plate 5 may be about 8 by 10 cm in size. The assembly may be worn upside-down, with strap 57 in slot 56*a*. Part of a boom line or cord 7 is indicated as passing through the hook 6. Arrows F—F indicate forces from the boom to which the ends of the line 7 are attached.

A pivot pin 61 passes through and is fixed to the base portion of hook 6, FIGS. 1–5. The hook 6 is held in place by a central folded ridge portion 81 of a generally flat leaf spring 8, which surrounds it. Spring 8 is tapered toward both ends in accordance with known design principles. Its upper end portion is fixed to the base plate 5 as by screw 82, FIGS. 1–4; or a rivet. Its lower end is held down by an adjusting nut 9. To tighten nut 9 (or other means of similar function) increases the preload, hence the force with which spring 8 urges the base portion of hook 6 against the base plate 5.

Figure 2:
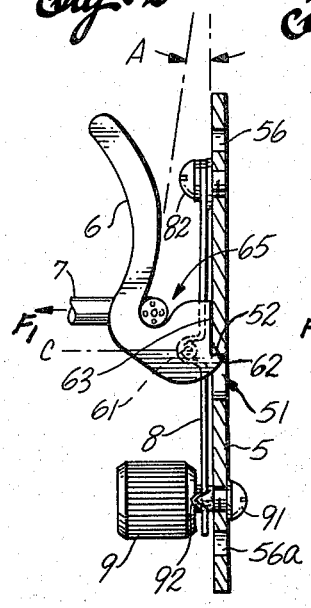
FIG. 2 is a sectional view on line 2—2 of FIG. 1.

In the preferred form of the invention, the base portion of hook 6 extends into a suitable hole or opening 83, FIG. 1, in the wide central portion of leaf spring 8. Beneath this opening is a latch slot 51 in base plate 5, FIGS. 2–5. The base end of hook 6 is notched at 62, 63, and engaging surface 62 of the notch engages the upper wall 52 of latch slot 51 in the general manner of the engagement of the trigger and sear on a gun. This engagement is shown in FIG. 2, and more clearly in a partly disengaged, intermediate stage in FIG. 5.

Figure 5:
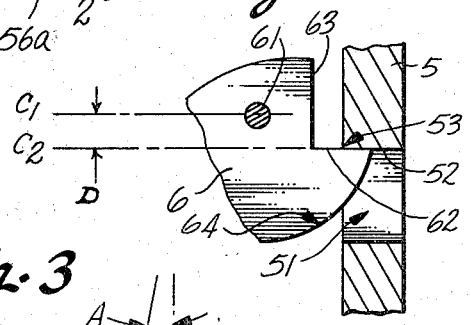
FIG. 5 is an enlarged partial sectional view showing the latch elements partly engaged.
Figure 3:
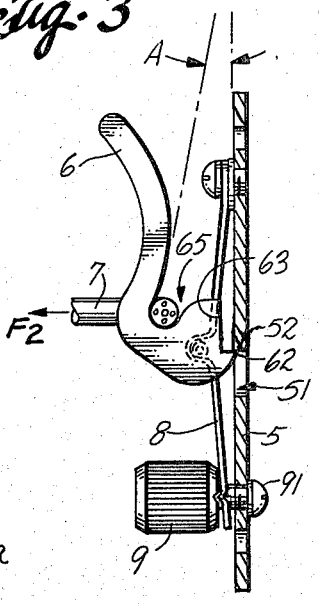
FIG. 3 is a section like FIG. 2 but showing the notch part-way disengaged.

FIG. 3 shows overall this intermediate state of operation where the force of boom line or cord 7 has increased from a moderate value $F_1$ to a value $F_2$ sufficient to deflect leaf spring 8 a little. Hook 6 has now moved bodily outward in translation a little from base plate 5, but not far enough to disengage the hook latch 52, 62. Engaging surface 62 has slid along surface 52 part way. The hook throat angle A with respect to the base plate is still the same. FIG. 5 shows this latching engagement to a larger scale.

Figure 4:
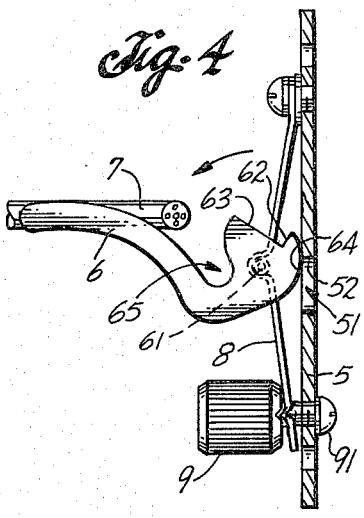
FIG. 4 is a section like FIG. 3 but showing the hook in the fully released position.

FIG. 4 shows the hook in the released state. The force received from line or cord 7 has now been sufficient to pull hook 6 clear of latching engagement at surfaces 52, 62 and has rotated the hook about its pivot 61 to release the line 7.

The amount of force required to disengage the latching means is adjustable by turning a suitable adjusting screw or equivalent device as at 9, FIGS. 1–4, which holds one end of leaf spring 8 and controls the preload thereon. The force required for release is typically of the order of 30 kg or more; spring 9 is quite stiff.

Once the latching engagement at 52, 62 is unlatched, it is desirable that hook 6 should pivot about pin 61 as easily as possible. In FIG. 4 it is seen that the hook 6, after release, is retained at pivot pin 61 and at a point of rubbing contact between the face of plate 5 and a curved hook base surface 64. Shown better in FIG. 5, this curved surface is given the profile of an arc of a circle centered on pivot pin 61, i.e., it is a right circular cylinder with pin 61 as its axis; hence rotation of the released hook (FIG. 4) about its pin will not change the deflection of spring 8, and only the torque due to friction need be overcome. This feature makes it easy to close and re-latch the hook. The sailor merely pushes the hook back to its latched position, where it clicks into place.

The relative alignment of the hook throat portion 65 (where the line or cord 7 rests), the pivot pin 61, and the latching surface 62 form part of the invention. Relative to an imaginary line C, FIG. 2, through pivot pin 61 and normal to base plate 5, the hook throat portion 65 is offset upward a little (toward the open end of the hook), and the latching surface portion 62 of the notch is offset about 2 mm or so the other way. The reason for the first offset is to provide a moment arm for the pull of the cord or line 7 so that it can rotate the hook open (FIG. 4) after it has been unlatched. The offset should be no more than is required to do this; if the offset is excessive the pull of the line will tend to force the latching surfaces 52, 62 into tighter engagement—which is not desirable.

The second offset is shown best in FIG. 5; it equals the distance D between the lines $C_1$ and $C_2$ drawn normal to plate 5. When the hook is latched as in FIG. 2, a flat plate-bearing surface portion 63 in the base portion of hook 6 is pressed against plate 5 by spring 8; it cooperates with the latching engagement at 52, 62 to prevent the hook 6 from rotating when latched. It has been found that the hook is steady enough when this second offset is zero ($C_1$ and $C_2$ coinciding) provided the edge 52 of hole 51 in plate 5, and its corner 53, FIG. 5, are sharp and unworn. When, however, the corner 53 becomes slightly rounded from wear, the hook when in the latched position would tend to rock slightly. The offset $C_1$–$C_2$ removes this difficulty because the spring force on the pivot pin 61 operates to hold flat surface 63 squarely against the plate 5, to resist rocking in either direction.

In sailing it is often desirable to change the spring preload to a different value, and then later to return to the previous setting, as in sailing with and against the wind. A known type of indexing or "click" device is hence preferably added to the adjusting nut mechanism as indicated at 92, FIG. 2. The end portion of spring 8 under the adjusting nut 9 is struck out in known manner into a small ridge which engages one or more mating grooves in the bottom surface of nut 9.

It is noted that a significant feature of the invention is parallel engagement of the surfaces 52, 62, urged along the said direction of said surfaces by spring 8 and engaging and releasing in the general manner of the trigger and sear of a firearm—but with the difference that the surfaces 52, 62 are rather long and the spring 8 is rather stiff, so that these surfaces slide along each other regularly during sailing or like use without sliding so far as to disengage; when the force from line or cord 7 relaxes somewhat the surfaces 52, 62 may slide back from a position such as shown in FIGS. 3 or 5 back to the position of FIG. 2. It is observed that on a firearm, the nearest analog, the trigger notch-to-sear engagement is very short, such as 0.01 to 0.03 mm, while in the present invention the engagement is of the order of the thickness of the base plate 5, or 3 mm.

In a working model of the invention the case plate 5 was about 7.6×10 cm×3 mm thick. The leaf spring 8 was about 7.7 cm long and 3.5 cm wide at the center, and about 1.1 mm thick. Preferably the parts are made of appropriate stainless steel alloys, with surface hardening at the latch-engaging surfaces.

It will be evident that this invention may be used in any application that requires a hook to release automatically when a predetermined, adjustable, pulling force is exceeded.

The embodiments of the invention in which an exclusive right or privilege is claimed are as follows:

1. An automatic-release latching hook assembly comprising: a base plate with a hole in its central portion; a latch hook extending outward from the front surface of said plate and having a base portion with a pivot pin through it, said pin extending generally parallel to said surface, and said base portion also intruding into said hole and having a notch latchably engagable with a side of said hole to prevent said hook from rotating about said pivot pin; and a leaf spring extending generally parallel to said surface and anchored thereto by anchoring means at its ends and having a folded central ridge portion fitting over said pivot pin to position said pin and urge said notch into engagement with said side of said hole; whereby an outward pulling force on said hook greater than a predetermined force will pull said notch out of engagement to permit said hook to rotate freely about said pivot pin and thereby disengage a line hooked into said hook.

2. The assembly of claim 1, wherein: one of said anchoring means of said spring is disposed to adjust the distance between a said end and said plate, to adjust said predetermined force.

3. The assembly of claims 1 or 2, wherein: said hook has a throat portion offset from a line through said pivot pin normal to said surface of said base plate by a small distance to provide a moment arm sufficient to make said pulling force rotate said hook about said pivot pin.

4. The assembly of claim 3, wherein: said notch on said hook includes a latching surface engageable with said side of said hole, and said latching surface when latched extends about perpendicular to said base plate along a line displaced about 1 to 4 mm from a perpendicular through said pivot pin, said displacement being in the direction away from the open end of said hook.

5. The assembly of claim 3, further comprising: a curved outer surface on the base portion of said latch hook adjacent said notch and disposed for bearing on the front surface of said plate near said hole when said notch is out of said engagement, said bearing being urged by said spring, said curved outer surface being shaped as a right circular cylinder with its axis on said pivot pin; whereby rotation of said hook does not change the deflection of said spring, but is resisted only by friction.

6. The assembly of claim 5, further comprising: slots in the edge portions of said base plate adapted to receive and hold harness straps.

7. The assembly of claim 2, wherein said anchoring means comprises a manually rotatable threaded element and resilient click-type detent means.

* * * * *